US007645967B2

(12) United States Patent
Kim et al.

(10) Patent No.: US 7,645,967 B2
(45) Date of Patent: Jan. 12, 2010

(54) MICROWAVE OVEN

(75) Inventors: Yong-yeon Kim, Gyeongnam (KR); Dong-yool Lee, Gyeongnam (KR); Boo-youn Lee, Daegu (KR); Sang-hu Park, Daegu (KR); Soo-kil Park, Gyeongbuk (KR); Woon-jin Kim, Daegu (KR); Hyung-do Kim, Gyeongnam (KR); Sang-dong Park, Busan (KR); Gyu-ho Oh, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/325,435

(22) Filed: Jan. 5, 2006

(65) Prior Publication Data

US 2006/0113301 A1 Jun. 1, 2006

Related U.S. Application Data

(62) Division of application No. 10/742,875, filed on Dec. 23, 2003, now Pat. No. 7,012,230.

(30) Foreign Application Priority Data

Dec. 31, 2002 (KR) ..... 2002-0087830
Jan. 6, 2003 (KR) ..... 2003-0000632
Jan. 6, 2003 (KR) ..... 2003-0000633

(51) Int. Cl.
*H05B 6/64* (2006.01)
*H05B 6/80* (2006.01)

(52) U.S. Cl. ..... 219/756; 219/725

(58) Field of Classification Search ..... 219/756, 219/757, 758; 333/227, 228, 229, 230, 231, 333/232, 233

See application file for complete search history.

(56) References Cited

U.S. PATENT DOCUMENTS 4,679,416 A * 7/1987 Kambic ..... 70/143
4,794,218 A 12/1988 Nakano et al.

(Continued)

FOREIGN PATENT DOCUMENTS

CN 1055535 C 10/1991

(Continued)

*Primary Examiner*—Daniel L Robinson
(74) *Attorney, Agent, or Firm*—Birch, Stewart, Kolasch & Birch, LLP

(57) ABSTRACT

The present invention relates to a microwave oven. The microwave oven of the present invention comprises a cavity assembly which defines a cooking chamber therein and functions as a framework of the microwave oven, an outer casing which includes a top portion and side portions formed at both ends of the top portion to enclose the cavity assembly and interior parts and is provided with convexo-concave reinforcements at the top portion and at least one side portion, a door of which one side is connected to the cavity assembly to be a pivot center and which selectively causes the cooking chamber to be open and close, and a back plate which defines a rear face of the cavity assembly and is provided with a convexo-concave reinforcement formed along at least one edge portion thereof. According to the present invention constructed as such, there is an advantage in that external rigidity of the microwave oven is increased, whereby deformation of the microwave oven due to an impact or operating force can be minimized.

9 Claims, 15 Drawing Sheets

U.S. PATENT DOCUMENTS

| | | | | |
|---|---|---|---|---|
| 6,295,198 | B1 * | 9/2001 | Loh et al. | 361/683 |
| 6,369,372 | B1 | 4/2002 | Kim | |
| 6,452,142 | B2 | 9/2002 | Eke | |
| 6,528,773 | B2 | 3/2003 | Kim et al. | |
| 6,528,774 | B2 | 3/2003 | Lee | |
| 6,572,830 | B1 | 6/2003 | Burdon et al. | |
| 6,653,610 | B2 | 11/2003 | Ahn | |
| 6,747,255 | B2 * | 6/2004 | Lee et al. | 219/754 |
| 2004/0031792 | A1 * | 2/2004 | Han et al. | 219/739 |

FOREIGN PATENT DOCUMENTS

| | | | |
|---|---|---|---|
| CN | 1166587 | A | 12/1997 |
| EP | 0 430 584 | A2 | 6/1991 |
| EP | 0 430 584 | A3 | 6/1991 |
| EP | 0803683 | A1 | 12/1997 |
| GB | 2 104 645 | A | 3/1983 |

* cited by examiner

Unit : mm

Unit : mm

Unit : mm

Unit : mm

MICROWAVE OVEN

This application is a Divisional of application Ser. No. 10/742,875, filed on Dec. 23, 2003, now U.S. Pat. No. 7,012, 230 the entire contents of which are hereby incorporated by reference and for which priority is claimed under 35 U.S.C. § 120.

BACKGROUND OF THE INVENTION

1. Field of the Invention

The present invention relates to a microwave oven, and more particularly, to a microwave oven wherein rigidity of parts for defining an exterior appearance of the microwave oven is improved.

2. Description of the Prior Art

A microwave oven is one of electronic home appliances for kitchen for cooking food using frictional heat between molecules generated while disturbing molecular structures of the food by irradiating microwaves, which serves as a heating source, onto the food. The microwave oven is widely used not only in home but also in restaurants, feeding facilities or the like where a large quantity of food is simultaneously cooked, because of convenience of use for easy heating and cooking of food. A typical example of such a microwave oven is shown in FIG. 1.

Referring to FIG. 1, a cavity assembly 1 functions as a framework of a microwave oven. A cooking chamber 3 in which food is cooked is defined in the cavity assembly 1, and an electronic equipment installation chamber 5 is formed at one side of the cavity assembly 1 in a state where it is partitioned from the cooking chamber 3. A turntable 7 for turning the food thereon is installed in the cooking chamber 3. Parts for generating microwaves, such as a magnetron 9, a high voltage transformer 10 and a capacitor 11, are also installed in the electronic equipment installation chamber 5. Further, a blower fan 12 for cooling the aforementioned parts and generating airflow into/from the cooking chamber 3 is also provided in the electronic equipment installation chamber 5.

A door 13 for causing the cooking chamber 3 to be open and close is fixed and installed to one side of a front face of the cavity assembly 1. The door 13 is hingedly connected to the cavity assembly 1 and provided with a handle 15 at a side of a front surface of the door opposite to the side to which the door is hingedly connected. A control unit 17 for controlling the microwave oven is provided at the other side of the cavity assembly 1.

In general, an outer casing 19, which is made of a metal plate, defines an external appearance of the microwave oven at top and side surfaces thereof. The outer casing 19 is mounted to the cavity assembly 1 so as to enclose the cavity assembly 1 and to shield the electronic equipment installation chamber 5 from the outside.

A back plate 1' defines a rear face of the cavity assembly 1, more generally, a whole rear surface of the microwave oven.

The microwave oven constructed as such is operated in the following manner. That is, after the door 13 is opened, food to be cooked is put onto the turntable 7 in the cooking chamber 3, and the door 13 is then closed. Thereafter, the control unit 17 is operated to select and begin a desired cooking mode.

However, there are the following problems in the aforementioned conventional microwave oven.

The external appearance of the microwave oven is generally defined by the parts such as the back plate 1', the door 13 and the outer casing 19. In such a case, the external parts may be damaged by a variety of external forces.

The outer casing 19 is generally formed of a metal plate and defines the top surface and two opposite side surfaces of the microwave oven. Since the surfaces of the microwave oven are planar as a whole, they have weak resistance to the external forces. In particular, in a case where a surface area of the outer casing 19 becomes large as the size of the microwave oven is increased, rigidity of the outer casing 19 is relatively reduced and thus the deformation thereof are frequently produced.

In addition, a clamping means is frequently used to carry the microwave oven. In such a case, a clamping force produced when carrying the microwave oven is transmitted to a packaging box of the microwave oven, and thus, any deformation may be produced at the outer casing 19 or corners of the microwave oven. In order to overcome the problem, a disposable reinforcing material may be used, which results in an increase of costs and inconvenience in handling of the microwave oven.

Further, the microwave oven may inadvertently drop when carrying the microwave oven. At this time, if the microwave oven drops and one of the corners thereof comes into contact with the ground, impact load applied to the microwave oven is concentrated on the corner which in turn may be greatly deformed.

In addition, the back plate 1' defines the external appearance of the microwave oven as well as a rear face of the cavity assembly 1. The back plate 1' has a problem in that either border regions excluding portions to be welded for constituting the cavity assembly 1 or regions adjacent to a hole through which a power cable is drawn to the outside are relatively weak in view of their rigidity.

Finally, the door 13 also defines the external appearance of the microwave oven, and a force for opening the door 13 may cause the microwave oven to be deformed. That is, the handle 15 should be pulled outwards so as to open the door 13. However, since the door 13 is in a state where it is locked or fastened to the cavity assembly 1 with a latch (not shown), the door 13 cannot be opened until a force enough to overcome the locking force of the latch is applied thereto.

Therefore, the force exerted on the handle for opening the door 13 causes the door to be deformed or twisted, and consequently, a gap may be generated between a rear surface of the door 13 and the front face of the cavity assembly 1 due to repeated use of the door. Electromagnetic waves leak from the interior of the cooking chamber 3 through the gap, thereby exerting a bad influence on a user and causing cooking time to be lengthened.

SUMMARY OF THE INVENTION

The present invention is conceived to solve the aforementioned problems in the prior art. Accordingly, an object of the present invention is to increase rigidity of parts for defining an external appearance of a microwave oven.

Another object of the present invention is to increase rigidity of an outer casing of the microwave oven.

A further object of the present invention is to increase rigidity of edge portions of the microwave oven.

A still further object of the present invention is to increase rigidity of a back plate of the microwave oven.

A still further object of the present invention is to increase rigidity of a door of the microwave oven.

According to an aspect of the present invention for achieving the objects, there is provided a microwave oven, which comprises a cavity assembly which defines a cooking chamber therein and functions as a framework of the microwave oven, an outer casing which defines an external appearance of the microwave oven by enclosing the cavity assembly and interior parts, a door of which one side is connected to the cavity assembly to be a pivot center and which selectively causes the cooking chamber to be open and close, and a back plate which defines a rear face of the cavity assembly and is provided with a convexo-concave reinforcement formed along at least one edge portion thereof.

Preferably, the convexo-concave reinforcement is formed horizontally at an upper end of the back plate that adjoins a top surface of the outer casing, and the depth of the convexo-concave reinforcement is within a range of 1 to 8 mm. More preferably, the convexo-concave reinforcement is protruded or depressed uniformly as a whole.

Preferably, an additional convexo-concave reinforcement is formed in the back plate at a position adjacent to a perforated cord hole, and the additional convexo-concave reinforcement is rectangular.

According to another aspect of the present invention, there is provided a microwave oven, which comprises a cavity assembly which defines a cooking chamber therein and functions as a framework of the microwave oven, an outer casing which includes a top portion and side portions formed at both ends of the top portion to enclose the cavity assembly and interior parts and is provided with convexo-concave reinforcements at the top portion and at least one side portion, and a door of which one side is connected to the cavity assembly to be a pivot center and which causes selectively the cooking chamber to be open and close.

Preferably, the convexo-concave reinforcements are formed on all of the top and side portions, and a depth of each of the convexo-concave reinforcements is within a range of 0.5 to 5.0 mm. Further, each of the convexo-concave reinforcements may be formed to have the same depth throughout the reinforcement.

More preferably, a depth of the convexo-concave reinforcement formed at the side portion of the outer casing becomes smaller in a downward direction of the side portion.

According to a further aspect of the present invention, there is provided a microwave oven, which comprises a cavity assembly which defines a cooking chamber therein and functions as a framework of the microwave oven, an outer casing which defines an external appearance of the microwave oven by enclosing the cavity assembly and interior parts and includes chamfers formed at corners thereof, and a door of which one side is connected to the cavity assembly to be a pivot center and which causes selectively the cooking chamber to be open and close.

Preferably, the chamfers of the outer casing are formed by cutting the relevant corners from the outer casing and then attaching additional panels to the cut corners.

More preferably, an angle between a line L extending along an external edge of the outer casing and a border line of the chamfer is within a range of 30 to 60 degrees, and the chamfers are formed at least at rear corners of the outer casing.

According to a still further aspect of the present invention, there is provided a microwave oven, which comprises a cavity assembly which defines a cooking chamber therein and functions as a framework of the microwave oven, an outer casing which defines an external appearance of the microwave oven by enclosing the cavity assembly and interior parts, and a door of which one side is connected to the cavity assembly to be a pivot center and which causes selectively the cooking chamber to be open and close. The door further includes a door frame which defines a framework of the door, a door panel installed at a front surface of the door frame for defining an external appearance of the door, a handle which is installed on the door panel and on which an operating force for opening and closing the door is exerted, and a reinforcing member mounted on a side, opposite to the pivot center, where the handle is provided.

Preferably, a protruding portion and a recessed portion are formed in parallel along edges of the door frame, and a choke structure for preventing microwaves from leaking out is provided along edges of a rear surface of the door frame.

Further, the reinforcing member is preferably bent several times perpendicularly to a longitudinal direction thereof so that it can be simultaneously mounted on the protruding and recessed portions.

More preferably, the reinforcing member is bent once perpendicularly to a longitudinal direction thereof so that it can be mounted on a surface of the protruding portion and a connecting surface between the protruding and recessed portions.

Further, the reinforcing member may be formed of an elongated plate with a predetermined width corresponding to that of the protruding portion so that it can be mounted on the protruding portion.

Furthermore, the reinforcing member may be mounted on a rear surface of the door panel for connection with the handle and includes mounting portions fastened to the handle at both ends thereof and a linking portion with a predetermined length for linking the mounting portions.

In addition, a cross-sectional length of the linking portion of the reinforcing member is preferably formed to be smaller than those of the mounting portions.

According to a still further aspect of the present invention, there is provided a microwave oven, which comprises a cavity assembly which defines a cooking chamber therein and functions as a framework of the microwave oven, an outer casing which includes a top portion and side portions formed at both ends of the top portion to enclose the cavity assembly and interior parts and is provided with convexo-concave reinforcements at the top portion and at least one side portion, a door of which one side is connected to the cavity assembly to be a pivot center and which selectively causes the cooking chamber to be open and close, and a back plate which defines a rear face of the cavity assembly and is provided with a convexo-concave reinforcement formed along at least one edge portion thereof.

Preferably, chamfers are further formed at corners of the outer casing.

More preferably, the door includes a door frame which defines a framework of the door, a door panel installed at a front surface of the door frame for defining an external appearance of the door, a handle which is installed on the door panel and on which an operating force for opening and closing the door is exerted, and a reinforcing member mounted on a side, opposite to the pivot center, where the handle is provided.

According to the microwave oven of the present invention constructed as such, there is an advantage in that rigidity of external parts of the microwave oven can be relatively enhanced.

BRIEF DESCRIPTION OF THE DRAWINGS

The above and other objects, advantages and features of the present invention will become apparent from the following description of preferred embodiments given in conjunction with the accompanying drawings, in which.

DETAILED DESCRIPTION OF THE INVENTION

Hereinafter, preferred embodiments of a microwave oven according to the present invention will be explained in detail with reference to the accompanying drawings.

Figure 1:
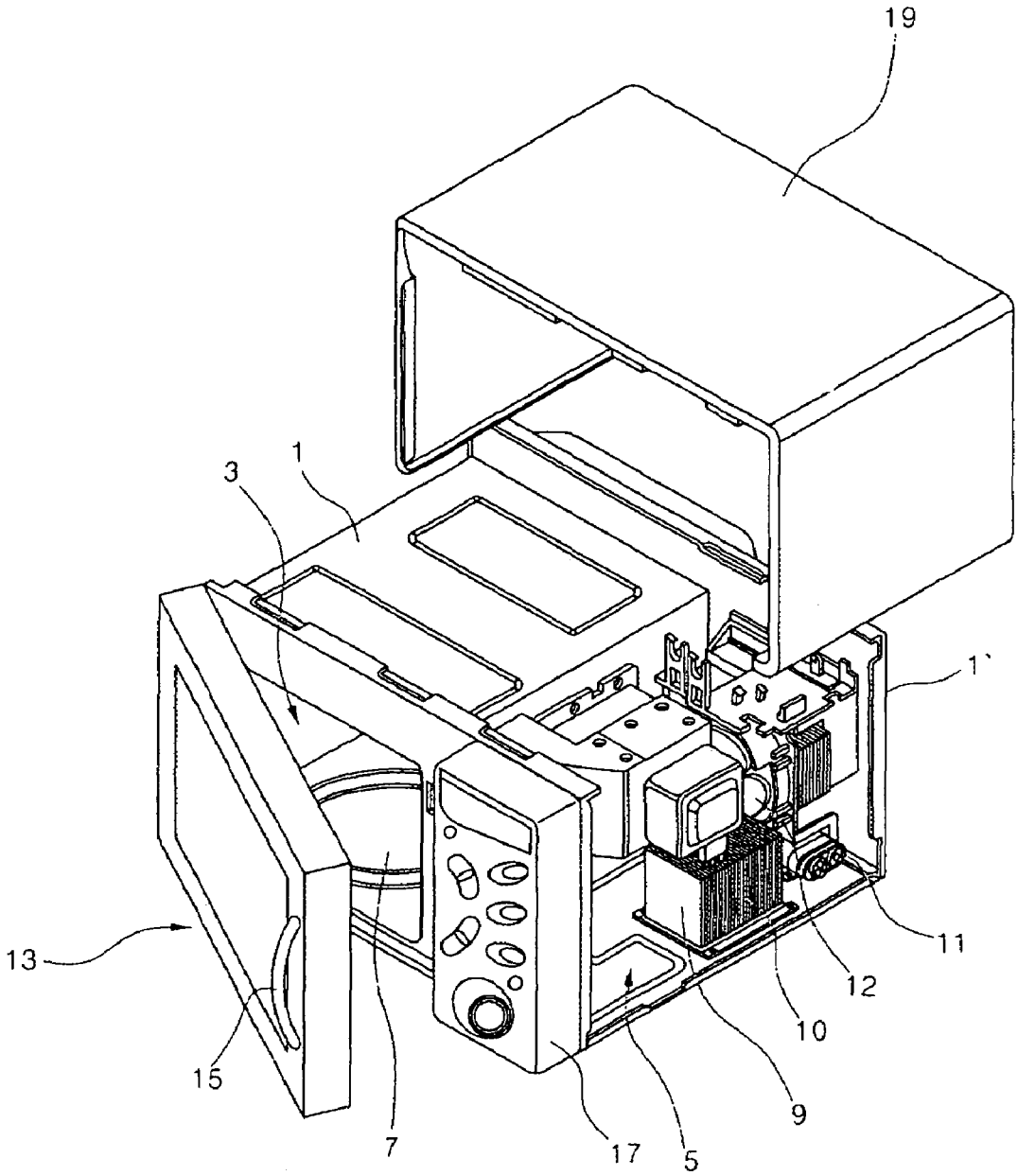
FIG. 1 PRIOR ART
FIG. 1 is an exploded perspective view showing a configuration of a conventional microwave oven.
Figure 2:
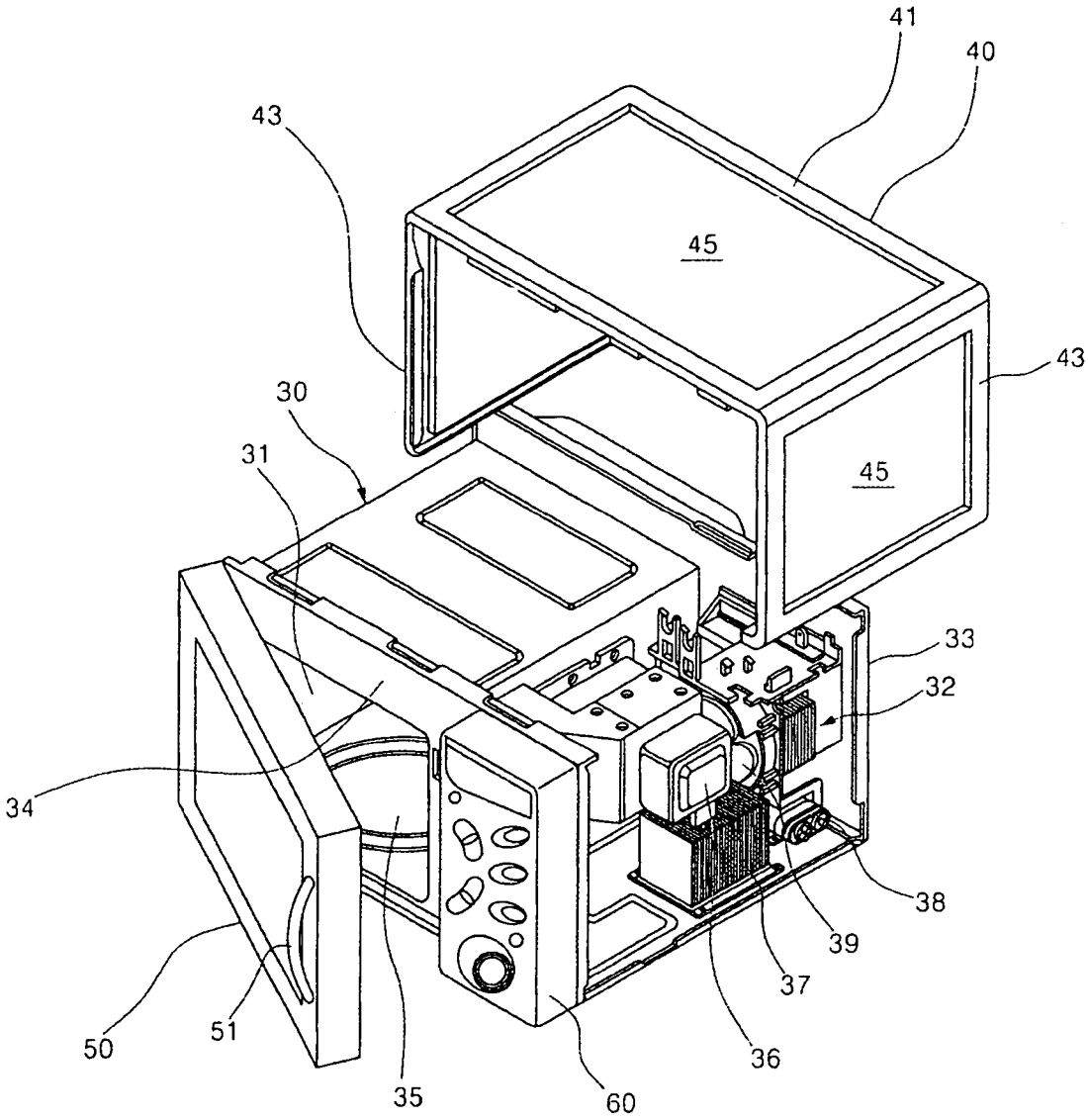
FIGS. 2 and 2*a* are exploded perspective views showing configurations of a microwave oven according to a preferred embodiment of the present invention.
Figure 2A:
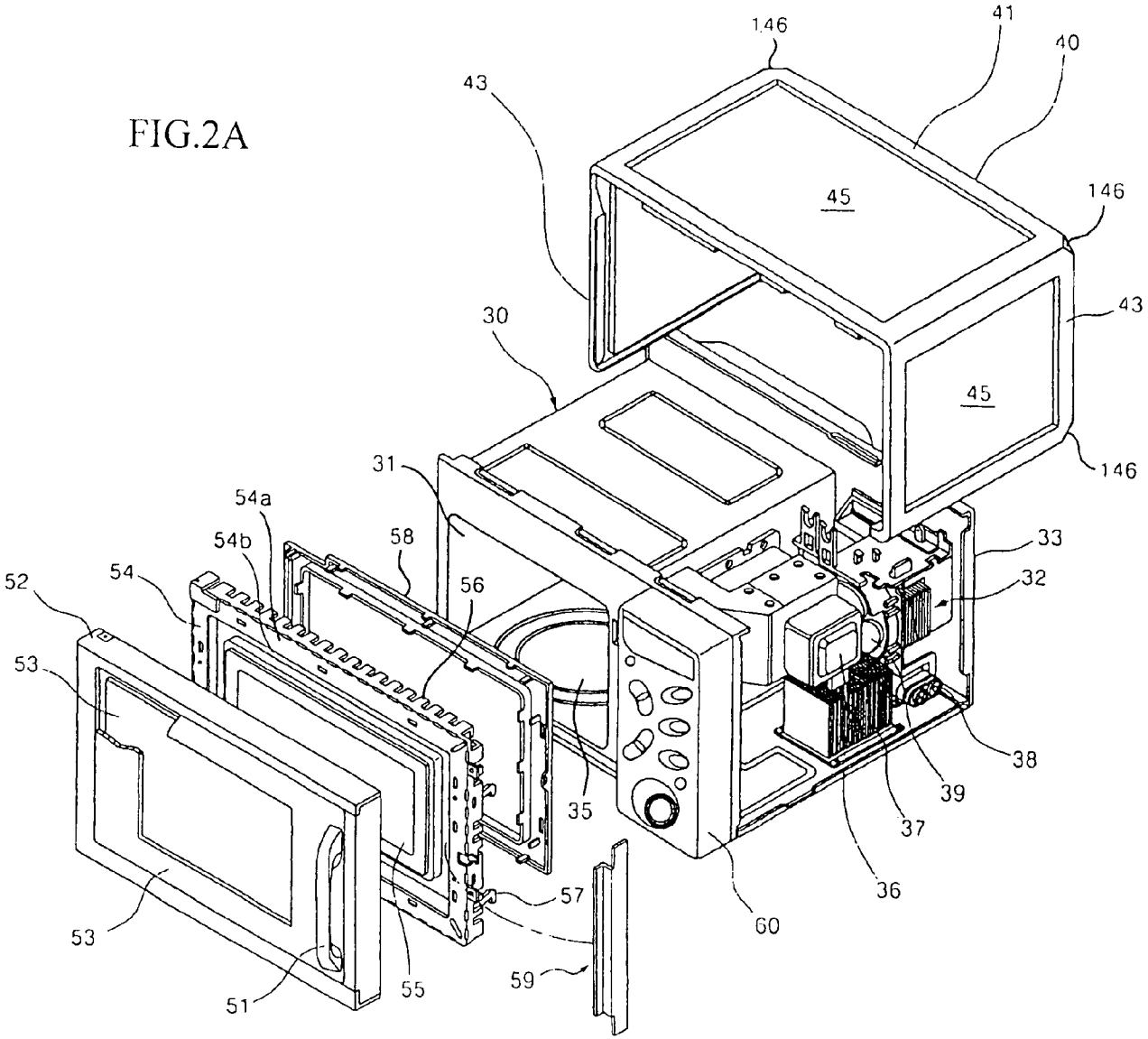

Referring to FIGS. 2 and 2A, a cavity assembly 30 defines a framework of a microwave oven. A cooking chamber 31 is formed within the cavity assembly 30, and an electronic equipment installation chamber 32 is formed at one side of the cavity assembly 30 next to the cooking chamber 31. A back plate 33 defines a rear face of the cavity assembly 30.

The back plate 33 is generally used to define a rear surface of the microwave oven as well as the rear face of the cavity assembly 30. A front plate 34 defines a front face of the cavity assembly 30. In the front plate 34, an opening corresponding to and communicating with the cooking chamber 31 is formed as an inlet of the cooking chamber 31. The back plate 33 and the front plate 34 are welded to the cavity assembly 30.

Figure 3:
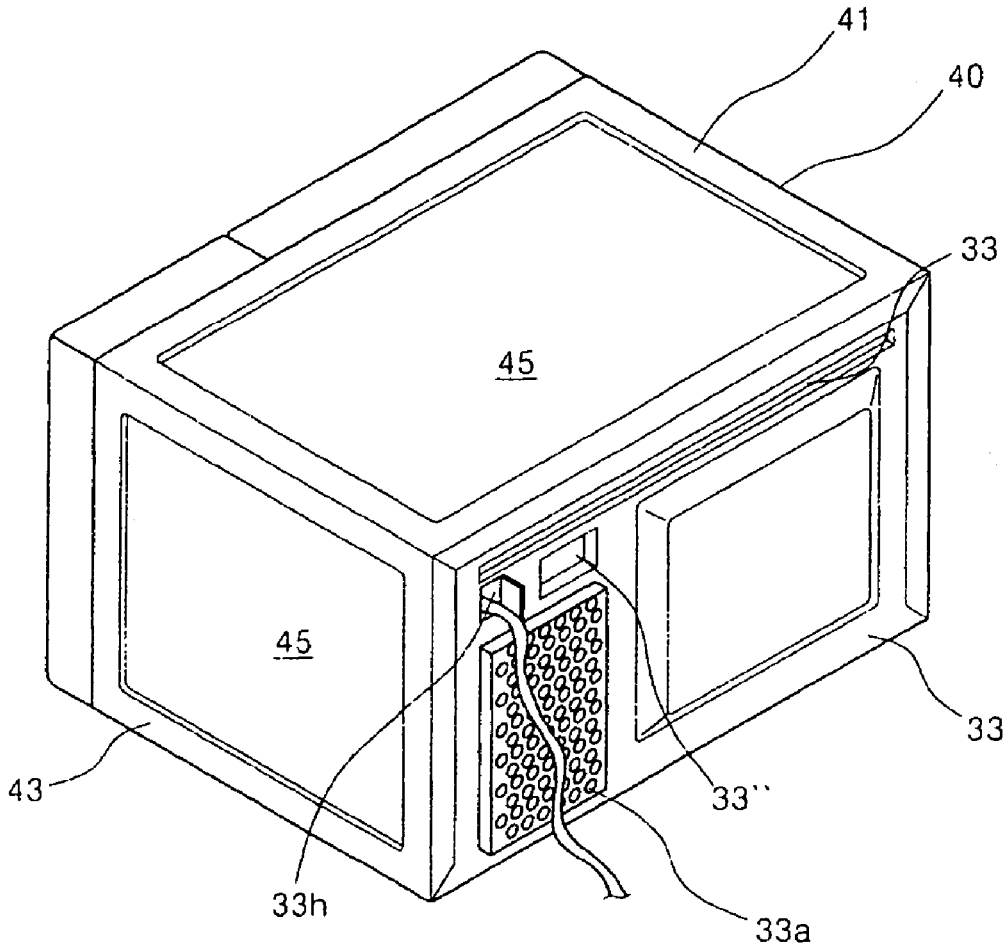
FIGS. 3 and 3A are rear perspective views of the microwave oven shown in FIGS. 2 and 2A, respectively.
Figure 3A:
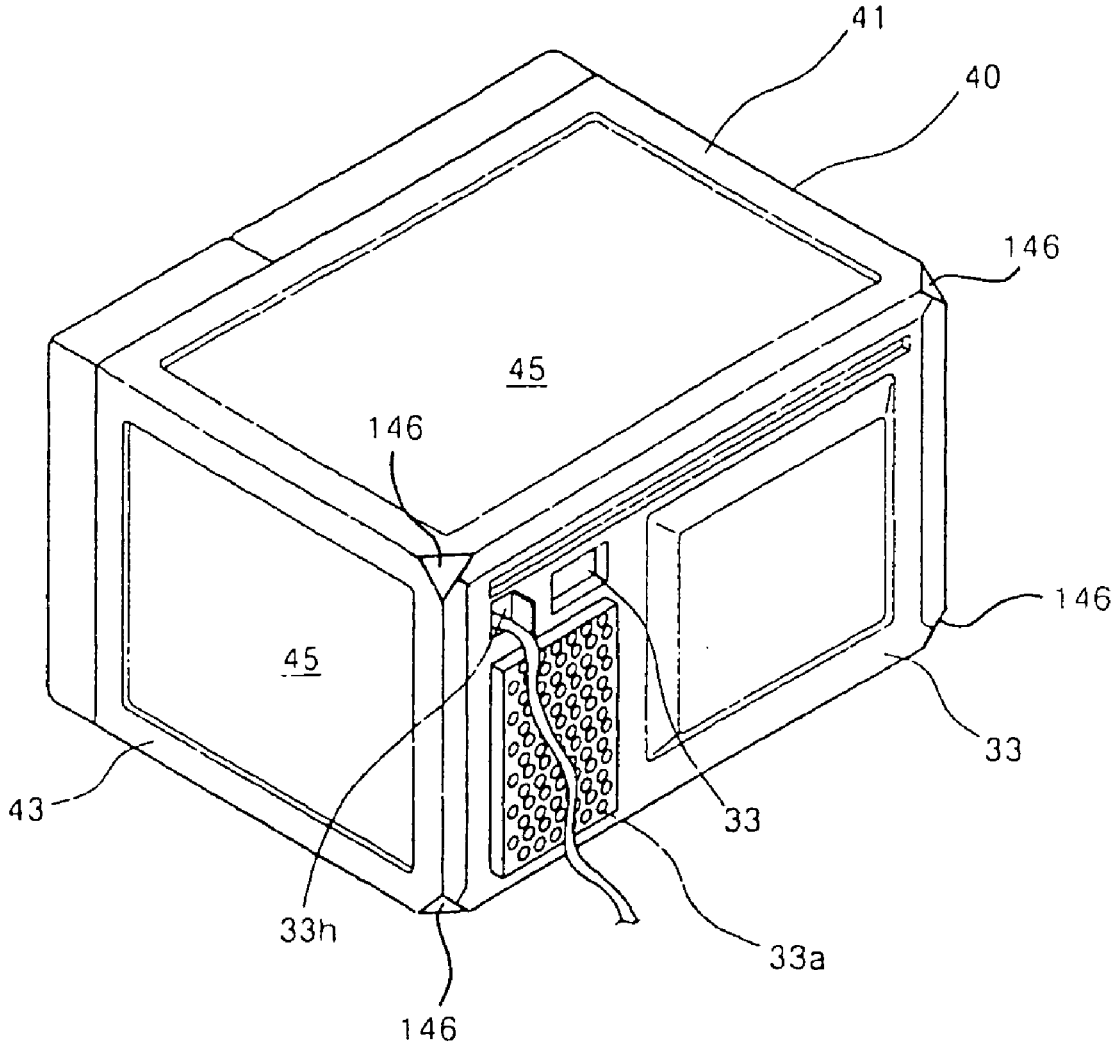

In the meantime, as shown in FIGS. 3 and 3A, air inlet holes 33*a* are formed in the back plate 33 at a position corresponding to the electronic equipment installation chamber 32. A cord hole 33*h* is formed on an upper portion of the back plate 33 corresponding to the electronic equipment installation chamber 32. A power cord for supplying the microwave oven with electric power passes through the cord hole 33*h*.

An elongated convexo-concave reinforcement 33' is formed at an upper end of the back plate 33, i.e. along a portion that is screwed and connected to a top portion 41 of an outer casing 40 to be described later. If the upper end of the back plate 33 is merely connected to the outer casing 40 without any support of an additional structure, it may be easily deformed. Thus, the convexo-concave reinforcement 33' can prevent this possible deformation of the upper center portion of the back plate 33. The convexo-concave reinforcement 33' is preferably depressed as viewed from the outside of the back plate 33. Such a convexo-concave reinforcement 33' functions to reinforce the rigidity of the back plate 33 and may be manufactured through press working.

An additional convexo-concave reinforcement 33" is also formed at a position adjacent to the cord hole 33*h*. The additional convexo-concave reinforcement 33" functions to reinforce the rigidity of the back plate 33 which may be relatively reduced by forming the cord hole 33*h*, the air inlet port 33*a* and the like on the back plate 33. It is preferred that the convexo-concave reinforcement 33" be formed to have a roughly rectangular shape, but it is not necessarily limited thereto. That is, the convexo-concave reinforcement 33" may be formed to have a circular shape.

According to this embodiment of the present invention, it is preferred that the convexo-concave reinforcements 33' and 33" be formed to be concave as viewed from the outside of the back plate 33, but it is not necessarily limited thereto. That is, the convexo-concave reinforcements 33' and 33" may be formed to protrude from an external surface of the back plate 33.

In the meantime, since the back plate 33 is used to define the rear surface of the microwave oven, it is not easily exposed to a user when it is actually in use. Therefore, since external beauty of the back plate is of little importance, the back plate 33 can be sufficiently reinforced without any limitation on depths or heights of the convexo-concave reinforcements 33' and 33". However, if the convexo-concave reinforcements 33' and 33" are formed to have relatively large depths or heights, there is a problem in that press workability therefore is reduced. Moreover, if the convexo-concave reinforcements 33' and 33" are excessively depressed or protruded, they may interfere with peripheral other parts or structures of the microwave oven.

In consideration of the foregoing, the inventors of the present invention conducted tests for the depths of the convexo-concave reinforcements 33' and 33". As a result, it is most preferred that the depths of the reinforcements be within a range of 1 to 8 mm. Here, the test results were obtained based on the back plate 33 made of a steel plate generally having a thickness of 0.5 to 0.7 mm.

Figure 4A:
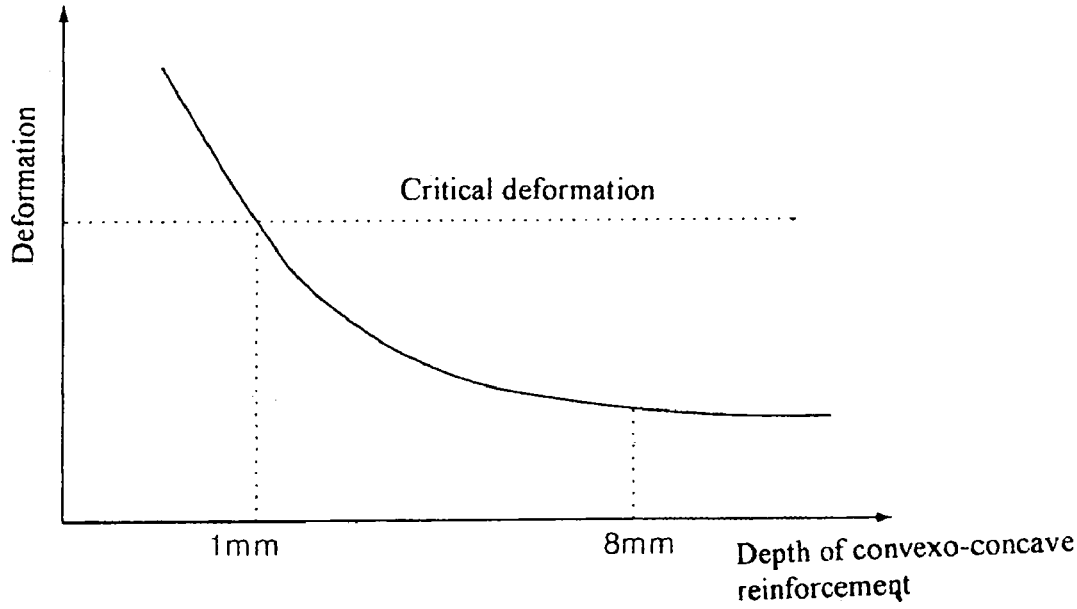
FIGS. 4*a* and 4*b* are graphs illustrating the relationship between the deformation and depth of a convexo-concave reinforcement.

FIG. 4*a* shows the relationship between the depth of convexo-concave reinforcement 33' or 33" and the deformation thereof due to an external force. As can be understood from the figure, when the convexo-concave reinforcements 33' and 33" are formed on the back plate 33, bending moment of inertia of the back plate is increased. Therefore, the deformation due to the external force is remarkably reduced. If the deformation is below a critical deformation, an original shape of the back plate can be sufficiently maintained due to an elastic recovery characteristic. Consequently, the rigidity of the back plate against the external force can be remarkably increased as compared with that of the conventional plate.

Food is cooked in the cooking chamber 31. A turntable 35 is installed within the cooking chamber 31. The turntable 35 allows the food thereon to be turned and thus microwaves to be uniformly transmitted to the food.

Various kinds of parts for generating microwaves are installed within the electronic equipment installation chamber 32. For example, a magnetron 36, a high-voltage transformer 37, and a high-voltage capacitor 38 are installed in the chamber 32. Further, a blower fan 39 for cooling the above parts is also provided.

The outer casing 40 is installed to enclose the cavity assembly 30. The outer casing 40 defines a top surface and both side surfaces of the microwave oven. The outer casing 40 is made of a metal plate by bending both ends of the metal plate downwards. Here, the outer casing 40 comprises a top portion 41 and side portions 43 which define the top surface and the both side surfaces of the microwave oven, respectively.

Each of the top portion 41 and side portions 43 of the outer casing 40 is provided with a convexo-concave reinforcement 45. The convexo-concave reinforcement 45 is formed to be depressed in a direction by performing press working for regions adjacent to borders of the top portions 41 and the side portions 43.

In the illustrated embodiment, all the reinforcements 45 of the top portion 41 and the side portions 43 of the outer casing 40 have rectangular shapes and are formed to be concave as viewed from the outside. A predetermined space is provided between the borders of the convexo-concave reinforcements 45 and the borders of the top portion 41 and the side portions 43.

The rigidity of the outer casing 40 can be remarkably improved by further forming the convexo-concave reinforcements 45 on the top portion 41 and the side portions 43 of the outer casing 40. In particular, the rigidity of the border portions where the top portion 41 and the side portions 43 intersect with each other are further remarkably enhanced.

In this embodiment, the convexo-concave reinforcements 45 are formed to be depressed inwardly from the external surface of the outer casing 40. However, the present invention is not limited thereto. On the contrary, the reinforcements may be formed to protrude outwardly from the external surface of the top portion 41 and the side portions 43 of the outer casing 40.

In the meantime, in order to achieve a desired advantage of the present invention, each of the convexo-concave reinforcements 45 should be formed to have an appropriate depth or height. However, if the depth or height of the reinforcement 45 is excessively large, the workability for the reinforcement is deteriorated and the reinforcement may interfere with the peripheral structures.

In consideration of the above factors, the inventors of the present invention have conducted a variety of tests for the depths of convexo-concave reinforcements 45 and obtained the following conclusion. That is, it is preferred that the depths of convexo-concave reinforcements 45 be within a range of 0.5 to 5.0 mm. Here, the test results were experimentally obtained on the assumption that the outer case 49 is made of a steel plate generally having a thickness of 0.6±0.1 mm.

Figure 4B:
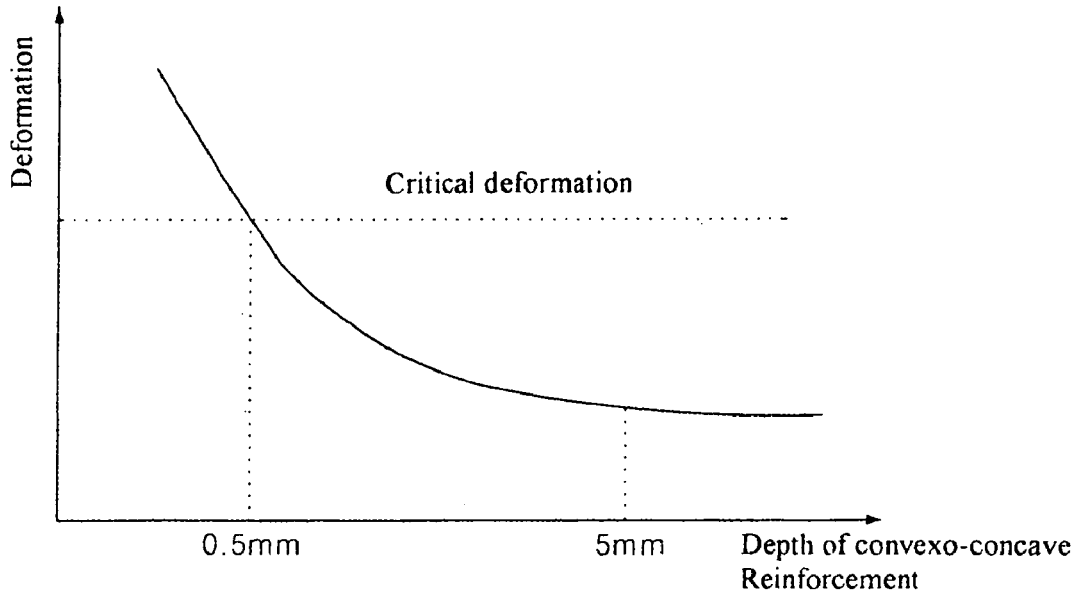

FIG. 4*b* shows the relationship between the depth of the convexo-concave reinforcement 45 and the deformation thereof due to an external force. That is, if the convexo-concave reinforcements 45 are formed on the outer casing 40 as in the embodiment of the present invention, bending moment of inertia of the outer casing is increased. Therefore, the deformation due to the external force is remarkably reduced. If the deformation is below a critical deformation, an original shape of the outer casing can be sufficiently maintained due to an elastic recovery characteristic. Consequently, the rigidity of the outer casing against the external force can be remarkably increased as compared with that of the conventional casing.

A door 50 is used to cause the cooking chamber 31 of the cavity assembly 30 to be open and close. The door 50 is hingedly connected to one side of the front plate 34 of the cavity assembly 30, and provided with a handle 51 at a side of a front surface thereof opposite to the side to which the door is hingedly connected.

Figure 5:
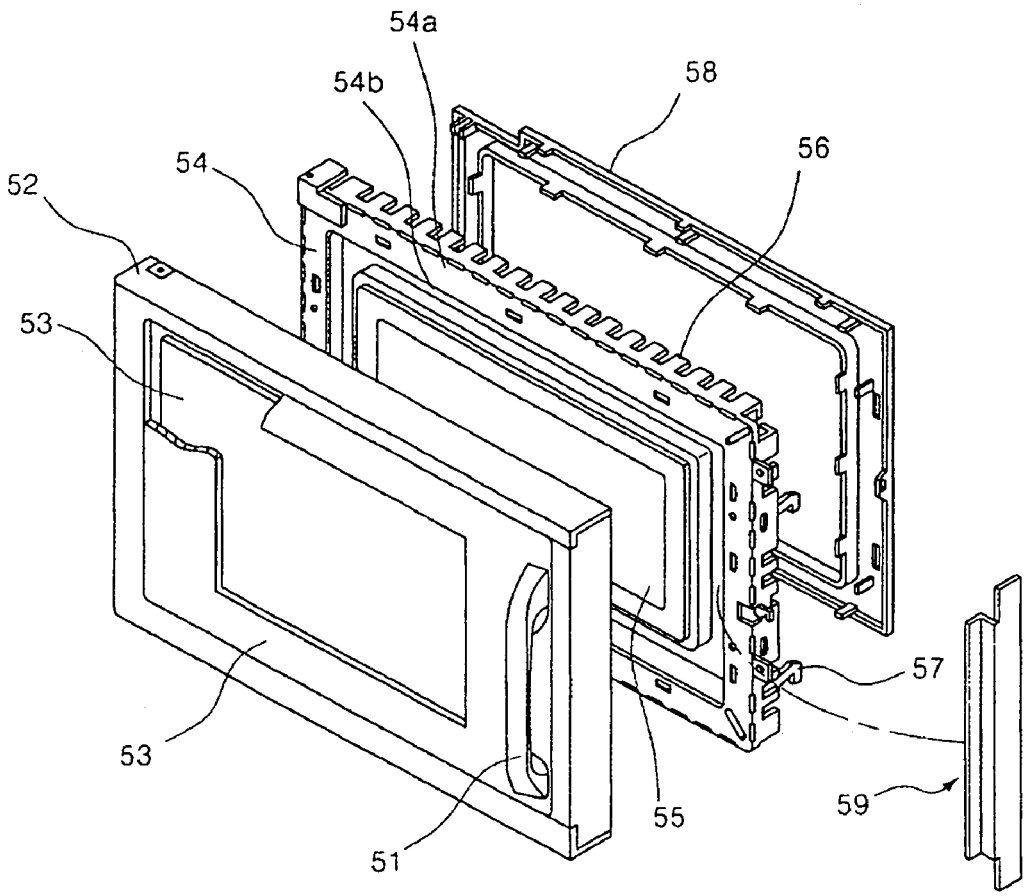
FIG. 5 is a partially cut-away exploded perspective view showing a configuration of a door used in the microwave oven shown in FIG. 2.

The configuration of the door 50 will be described in detail with reference to FIG. 5. A door panel 52 defines an external appearance of the door 50. The handle 51 is provided on the one side of the front surface of the door panel 52. A glass plate 53 through which the interior of the cooking chamber 31 can be viewed is fixed to the center of the front surface of the door panel 52 by a decorative plate 53'.

A door frame 54 is provided at a rear surface of the door panel 52. The door frame 54 functions as a framework of the door 50 and is provided at the center thereof with a porous zinc-plated steel plate 55 for allowing the electromagnetic waves to be shielded and also the interior of the cooking chamber 31 to be viewed. A protruding portion 54*a* is formed along a front edge portion of the door frame 54, and a recessed portion 54*b* is also formed inside of the protruding portion 54. The recessed portion 54*b* is depressed inwardly from a front surface of the door frame 54 as compared with the protruding portion 54*a*.

A choke structure 56 is formed along a rear edge portion of the door frame 54, and functions to prevent the electromagnetic waves in the cooking chamber 31 from leaking to the outside through the door 50. Reference numeral 57 denotes a latch for keeping the door 50 closed.

A choke cover 58 is also mounted to a rear surface of the door frame 54. The choke cover 58 defines a rear border of the door 50 and functions to shield the choke structure 56.

Figure 6:
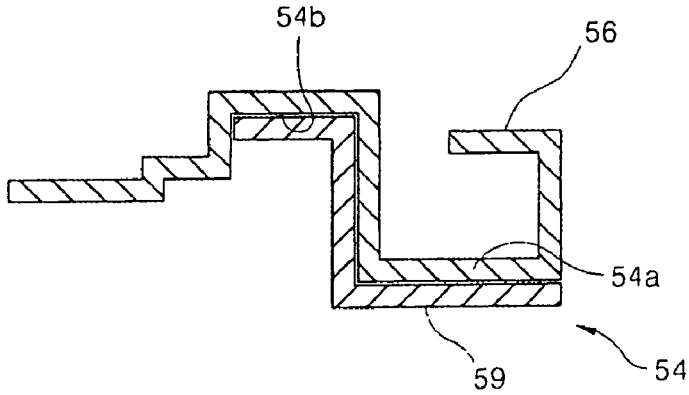
FIG. 6 is a partial sectional view showing a structure of an essential part of the door shown in FIG. 5.

Furthermore, a reinforcing plate 59 is provided at one side of the door frame 54. The reinforcing plate 59 is installed at the same side of the door frame 54 where the handle 51 is provided on the door panel 52. As shown in FIG. 6, the reinforcing plate 59 is mounted to the door frame 54 by means of a predetermined process such as a welding process. As can be understood from the figure, the reinforcing plate 59 is formed to come into close contact with a front surface of the protruding portion 54*a*, a floor surface of the recessed portion 54*b* and a connecting surface between the protruding and recessed portions 54*a* and 54*b*. That is, the reinforcing plate 59 is bent twice in a direction perpendicular to a longitudinal direction thereof.

Figure 7:
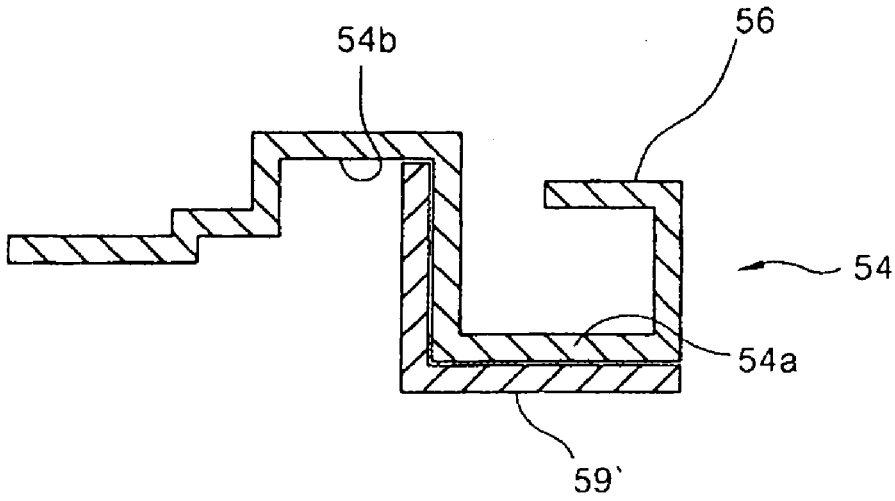
FIG. 7 is a partial sectional view showing an example of the door of FIG. 5 in which a reinforcing plate is modified.

FIG. 7 shows a modified example of a reinforcing plate 59' of the door frame 54. In this example, the reinforcing plate 59' is formed to come into close contact with the front surface of the protruding portion 54*a* and the connecting surface between the protruding and recessed portions 54*a* and 54*b*. That is, the reinforcing plate 59' is bent only once in a direction perpendicular to a longitudinal direction thereof.

Figure 8:
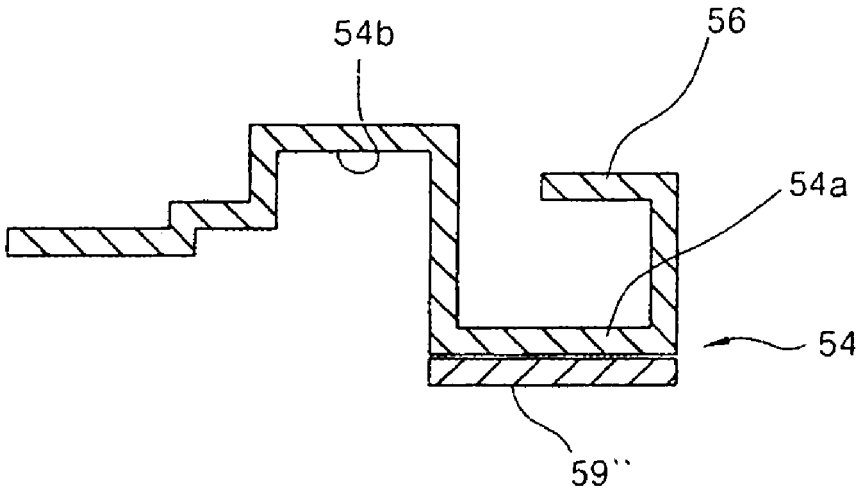
FIG. 8 is a partial sectional view shown another example of the door of FIG. 5 in which a reinforcing plate is modified.

FIG. 8 shows another modified example of a reinforcing plate 59" of the door frame 54. In this example, the reinforcing plate 59" is attached to the front surface of the protruding portion 54*a*. Thus, the reinforcing plate 59" is manufactured in the form of an elongated band.

According to the modified examples of the embodiment of the present invention, the reinforcing plate 59 of FIG. 6 can relatively further improve the rigidity of the door frame 50, thereby most efficiently preventing the door 50 from being twisted or distorted in use. However, there is a disadvantage in that the reinforcing plate 59 requires additional materials and processing costs as compared with the reinforcing plate 59' and 59" shown in FIGS. 7 and 8, respectively.

Figure 9A:
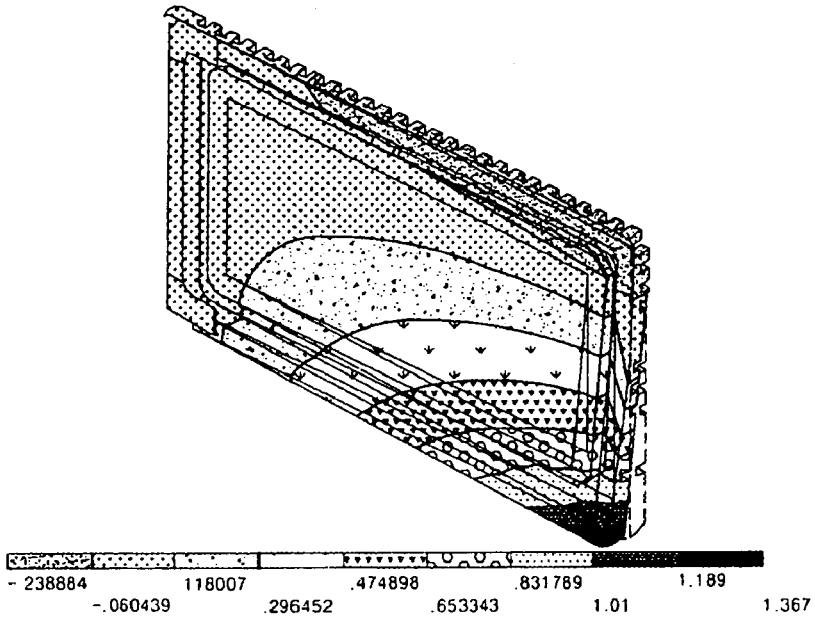
FIGS. 9*a* and 9*b* are plots illustrating deformed states of a conventional door and the door shown in FIG. 5, respectively.
Figure 9B:
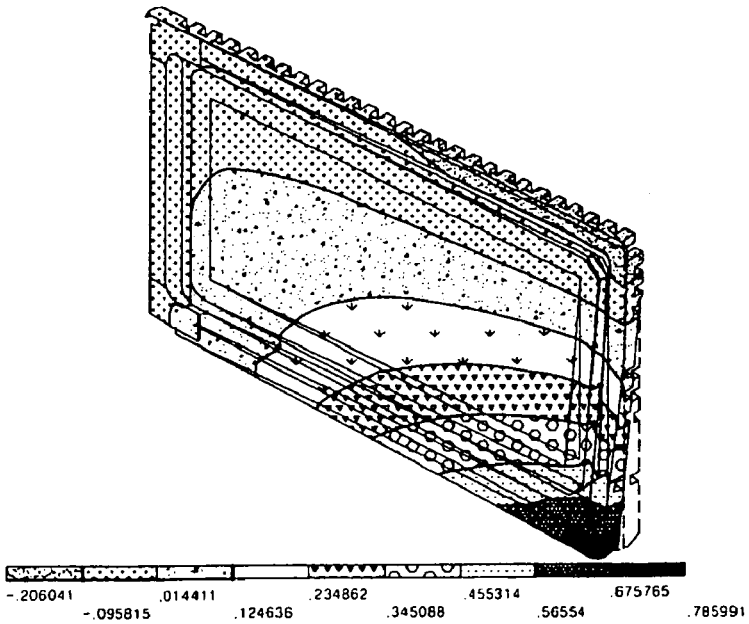

In the meantime, deformation distribution in the door 50 due to twisting or distortion generated upon actual use of the door is illustrated in FIGS. 9*a* and 9*b*. That is, FIGS. 9*a* and 9*b* illustrate the deformation distribution due to the twisting or distortion generated in the conventional door and the door of the present invention, respectively.

Referring to these figures, it can be understood that the deformation in a right lower corner region is greater than those in the other regions. The reason is that a user generally grasps a lower portion of the handle 51 and pulls the handle 51 when he/she intends to open the door 50. Thus, the deformation in the right lower corner region of the door 50 corresponding to a side opposite to which the door 50 is connected is largest in a forward direction. Further, in a case where the deformation in the right lower corner region is instantaneously produced, deformation in the left upper corner region will be produced in a rearward direction by means of reaction thereto. Consequently, the deformation in the right lower corner region is largest.

However, by comparing FIGS. 9*a* and 9*b* with each other, it can be understood that maximum deformation of the conventional plate is 1.367 mm whereas maximum deformation of the plate of the present invention is about 0.786 mm. Thus, it is deemed that the reinforcing plate 59 is greatly advantageous in preventing the deformation.

Next, another preferred embodiment of the present invention will be explained with reference to FIGS. 10 to 12. In this embodiment of the present invention, an outer casing 140 defines a top surface and both side surfaces of the microwave oven. The outer casing 140 comprises a rectangular flat top portion 141 and side portions 143 that are bent almost perpendicularly from both longitudinal ends of the top portion 141.

Figure 10:
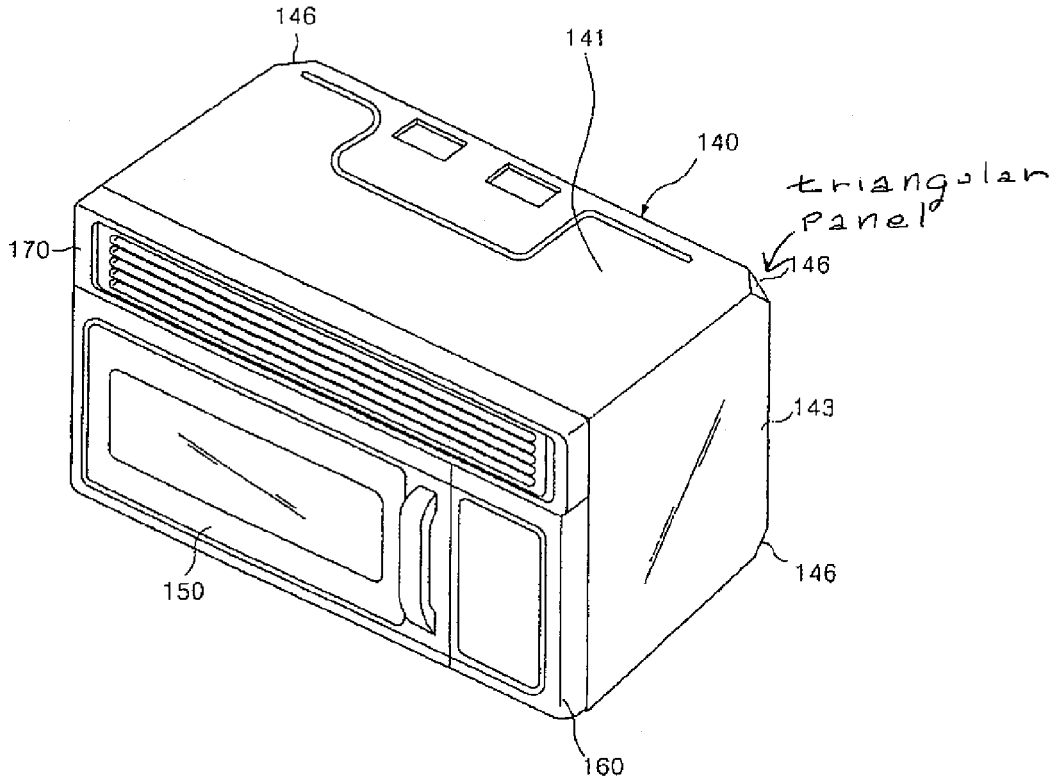
FIG. 10 is a perspective view showing a configuration of a microwave oven according to another preferred embodiment of the present invention.

Chamfers 146 are formed at rear ends of edge portions where the top portion 141 and the side portions 143 intersect with each other, as shown in FIGS. 2A, 3A and 10. The chamfers 146 may be formed in the various manners: i.e., they may be formed directly on the outer casing 140 or formed by chamfering rear corners of the outer casing 140 and then welding additional chamfer pieces on the chamfered corners. In such a case, relevant portions of the cavity assembly or base plates (not shown) corresponding to the corners on which the chamfers 146 are formed should be manufactured to have a shape corresponding to inner portions of the chamfers 146.

Figure 11:
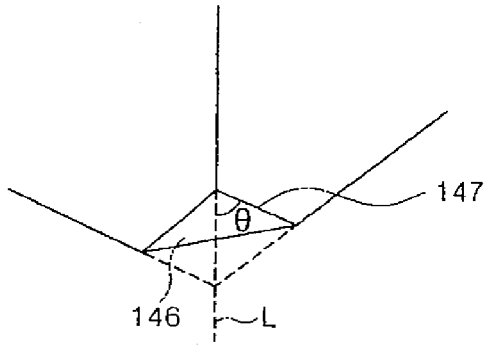
FIG. 11 is a view showing a shape of a chamfer that is employed in the microwave oven shown in FIG. 10.

FIG. 11 shows an angle θ that is formed by a line L extending along one of the external edges of the microwave oven and a border line of the chamfer 146 of the present invention when the chamfers 146 are formed on the outer casing 140. Preferably, the angle θ is within a range of 30 to 60 degrees. The reason is that if the angle is beyond the range of 30 to 60 degrees, excessively sharp edges are again formed.

In the meantime, a door 150 for opening and closing a cooking chamber, a control unit 160 for controlling the operation of the microwave oven, and a vent grille 170 for allowing air to flow into/from the microwave oven are provided at the front surface of the microwave oven according to this embodiment of the present invention.

Figure 12:
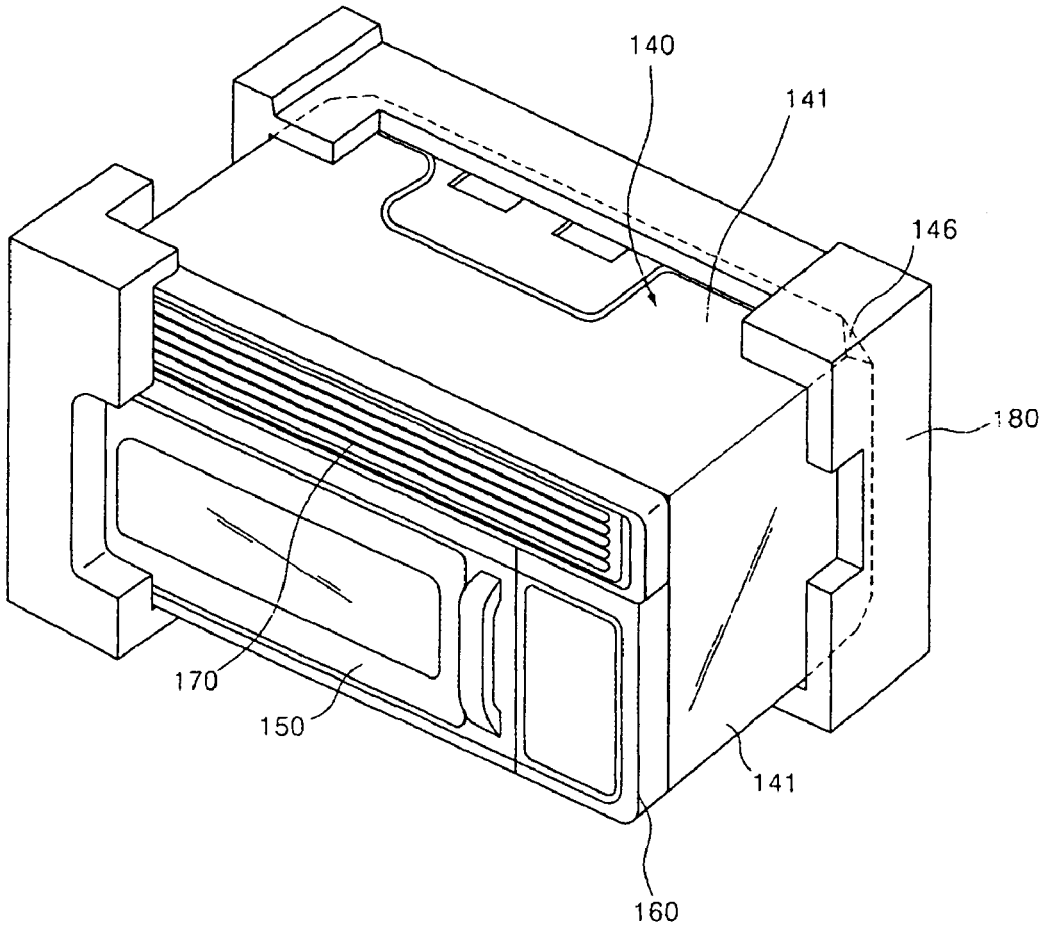
FIG. 12 is a perspective view showing that shock-absorbing materials are mounted on the microwave oven shown in FIG. 10.

FIG. 12 shows a microwave oven with shock-absorbing materials 180 mounted thereon for packaging the microwave oven of the present invention. The shock-absorbing materials 180 are mounted on the microwave oven and then secured into a packaging box so that an external impact or shock cannot be transmitted to the microwave oven.

In the microwave oven according to this embodiment of the present invention, the chamfers 146 allow predetermined spaces to be defined between the shock-absorbing materials 180 and the corners of the microwave oven. The spaces function as a kind of shock-absorbing space, thereby remarkably reducing the shock or impact transmitted from the shock-absorbing materials 180 to the chamfers 146.

Of course, portions of the shock-absorbing material 180 corresponding to the chamfers 146 may be shaped to be in close contact with the chamfers 146. Even in such a case, the shock or impact cannot be concentrated since the contact surface area between the shock-absorbing material 180 and each of the chamfers 146.

FIGS. 13 to 16 show a large capacity microwave oven according to another preferred embodiment of the present invention, wherein a lower end of a door of the microwave oven is hingedly connected to a cavity assembly and an upper end thereof is pivoted vertically on the hinged lower end so that a cooking chamber can be opened and closed.

Referring to these figures, a cavity assembly 230 defines a framework of the microwave oven. A cooking chamber 231 for cooking the food therein is formed within the cavity assembly 230. Although it has not been illustrated in the figures, an electronic equipment installation chamber in which various kinds of electronic equipment used for generating microwaves are installed is also provided at a side of the cavity assembly 230.

A turntable 235 for allowing the food thereon to be turned and the microwaves to be uniformly transmitted to the food is provided in the cooking chamber 231. Latch slots 237 into which latches 257 to be explained later are inserted are formed at both sides on an upper front surface of the cavity assembly 230.

An outer casing 240 is installed to enclose top and side faces of the cavity assembly 230. The outer casing 240 defines a top surface and both side surfaces of the microwave oven.

A door 250 is installed at a front face of the cavity assembly 230. The door 250 functions to cause the cooking chamber 231 to be open and close. In this embodiment of the present invention, a lower end of the door 250 is hingedly connected to a front lower end of the cavity assembly 230. Thus, an upper end of the door 250 is pivoted on the lower end hingedly connected to the cavity assembly 230 so that the door 250 can cause the cooking chamber 231 to be open and close.

A handle 251 is installed at a front upper end of the door 250, i.e. at a portion corresponding to a side opposite to which the door 250 is connected to the cavity assembly 230. The handle 251 is a part which a user grasps and applies a force to intend to open and close the door 250.

Figure 14:
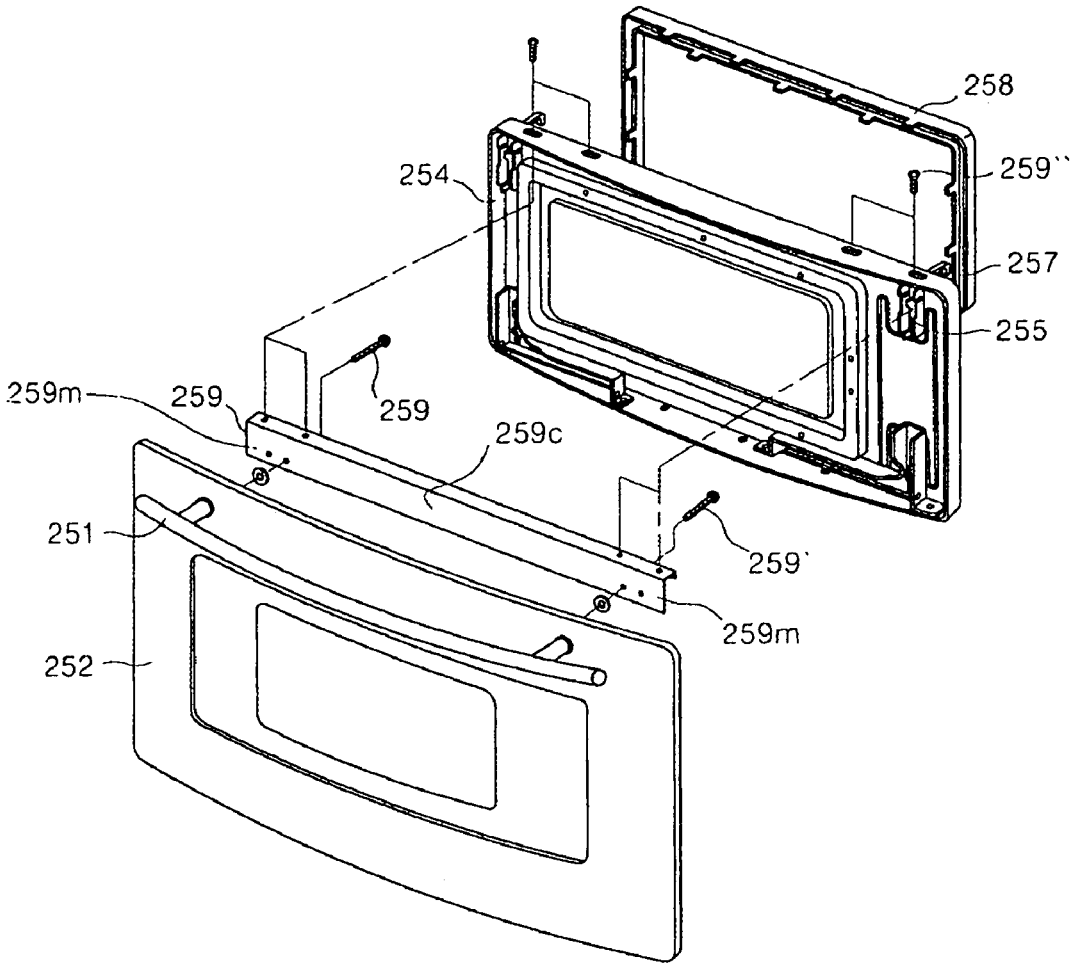
FIG. 14 is an exploded perspective view of a door used in the microwave oven of FIG. 13.
Figure 15:
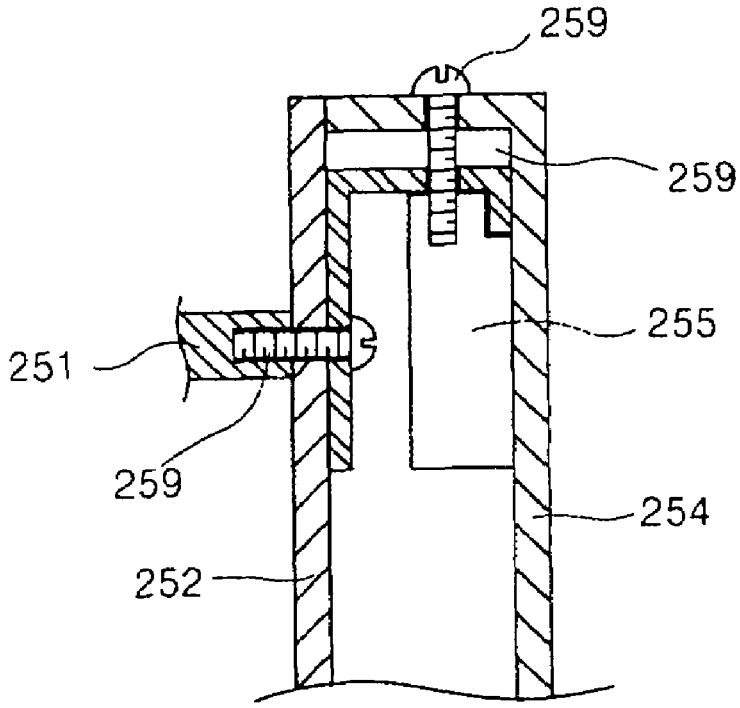
FIG. 15 is a sectional view showing a structure of an essential part of the door shown in FIG. 13.

An interior configuration of the door 250 will be explained with reference to FIGS. 14 and 15. A door panel 252 defines a front external appearance of the door 250. A structure through which the interior of the cooking chamber 231 can be viewed is provided at the center of the door panel 252.

A door frame 254 is installed on a rear surface of the door panel 252. The door frame 254 functions as a framework of the door 250, and is generally formed to have a rectangular shape and a perforated central portion. The door frame 254 is provided with a supporting member 255 for connection with the door panel 252. The supporting member 255 is constructed to have a '⊏' shaped cross section. The latches 257 are provided at opposite ends of the rear surface of the door frame 254 to protrude from the rear surface. That is, when the door 250 is closed, the latches 257 are inserted into the latch slots 237 to prevent the door 150 from being inadvertently opened. Of course, the latches 257 also function to detect whether the door 250 is opened or closed.

A choke cover 258 is further provided at the rear surface of the door frame 254 to prevent the leakage of microwaves. The choke cover 258 is formed to have a rectangular frame and functions to shield a choke structure that is formed to enclose the edge portions of the door frame 254.

Furthermore, a reinforcing bar 259 is installed at the rear surface of the door panel 252. The reinforcing bar 259 is fastened to the door panel 252 and the door frame 254. That is, as shown in FIG. 15, the reinforcing bar 259 is fastened to the door panel 252 and then the handle 251 through screws 259' and to the door frame 254 through screws 259".

Further, the reinforcing bar 259 is hooked over the supporting member 255. To this end, the reinforcing bar 259 is constructed to have a '⊏' shaped cross section. The reinforcing bar 259 is formed to extend from side to side so that both ends thereof can be coupled to the opposite ends of the handle 251.

Therefore, the reinforcing bar 259 has a length as large as the length of the handle 251. The reinforcing bar 259 includes mounting portions 259*m* mounted to the door panel 252 at the both ends thereof and a linking portion 259*c* for linking the mounting portions 259*m* with each other. A plurality of coupling holes are formed in each of the mounting portions 259*m*. The reinforcing bar 259 is formed in such a manner that cross sections of the mounting portions 259*m* and the linking portion 259*c* are identical to one another. Therefore, the lengths of cross sections thereof are equal to one another.

By forming the reinforcing bar 259 in the above manner, the rigidity of the door 250 can be enhanced as a whole. In particular, when the door 250 is opened and closed, an external force is concentrated on the handle 251, whereby large deformation may be produced in the door 250. Consequently, the reinforcing bar 259 functions to improve the rigidity of the door 250 and thus to prevent the door from being deformed.

Figure 16:
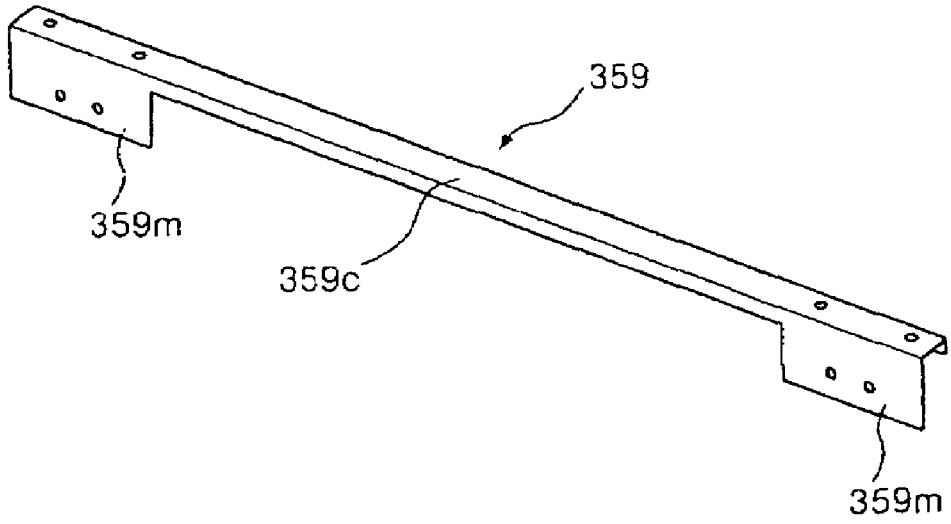
FIG. 16 is a perspective view showing an example of the door of FIG. 14 in which a reinforcing bar is modified.

In the meantime, FIG. 16 shows a modified example of a reinforcing bar according to the embodiment of the present invention. The reinforcing bar 359 of FIG. 16 includes mounting portions 359*m* fastened to the handle at both ends thereof and a linking portion 359*c* for linking the mounting portions 359*m* with each other.

In the modified example, the mounting portions 359*m* and the linking portion 359*c* are formed to have different cross-sectional shapes. That is, the length of the cross section of the linking portion 359*c* is shorter than those of the mounting portions 359*m*. In other words, a surface area of the linking portion 359*c* is relatively small, i.e. smaller than that of the linking portion 259*c* of the reinforcing bar 259 shown in FIG. 14.

Figure 17A:
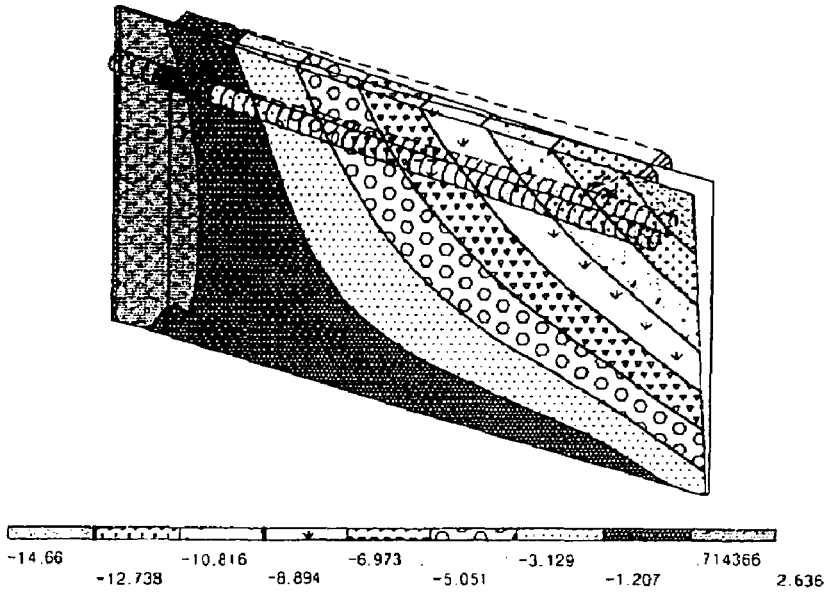
FIGS. 17*a* and 17*b* are plots illustrating deformed states of a conventional door and the door used in the microwave oven of FIG. 13, respectively.
Figure 17B:
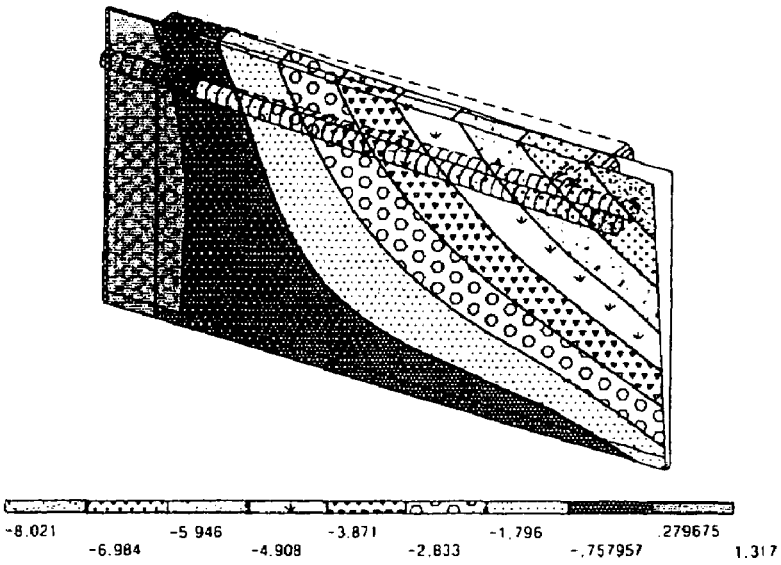

FIGS. 17*a* and 17*b* illustrate deformation distribution in the door 250 due to twisting or distortion produced when the door 250 is opened or closed by using the handle 251 in cases where the reinforcing bar 259 is not employed in the door 250 according to the prior art and where the reinforcing bar 259 is incorporated into the door 250 according to the present invention, respectively.

As can be shown from FIGS. 17*a* and 17*b*, when the user pulls the handle 251 of the door 250, a left side of the door 250 is deformed forward while a right upper corner thereof is deformed relatively rearward. Further, the deformation in the right upper corner of the door 250 becomes relatively large, and thus, the maximum deformation is produced at this point.

However, the maximum deformation in the conventional door becomes 14.66 mm rearward as shown in FIG. 17*a*, whereas the maximum deformation in the door 250 according to the present invention becomes 8.021 mm rearward as shown in FIG. 17*b*. Thus, it can be understood from the foregoing that the deformation in the door according to the present invention is relatively reduced.

The present invention is not limited to the aforementioned embodiments of the present invention and can be modified in the following various manners.

For example, although the convexo-concave reinforcements are formed along the upper end of the back plate in the embodiment of the present invention, the rigged reinforcements may be formed along entire edges of the back plate.

Further, although the convexo-concave reinforcements are formed to have the same depths or heights as a whole, they may be formed to have different depths or heights. For example, in consideration of interference with or positional relationship between a variety of electronic equipment installed in the microwave oven, the convexo-concave reinforcements may be formed to have different depths or heights in accordance with their positions.

Furthermore, the convexo-concave reinforcements formed on the side portions of the outer casing may be formed in such a manner that their depths or heights become smaller in the rearward direction. In such a case, convexo-concave reinforcements with almost no depth or height may be formed on rear ends of the side portions of the outer casing.

In addition, although all the structures for reinforcing the back plate, the outer casing and the door are employed in the embodiment shown in FIG. 2, they may be applied individually or in combination to the microwave oven.

That is, only the convexo-concave reinforcement for the back plate or only the convexo-concave reinforcement for the outer casing may be applied to the microwave oven. Only the door with the reinforcing plate incorporated therein may be applied to the microwave oven. Of course, the convexo-concave reinforcements may be applied to the back plate and the outer casing, respectively.

Moreover, the chamfers of FIG. 10 can be applied to the microwave oven shown in FIG. 2. Of course, the chamfers may be applied to the microwave oven in combination with the structures for reinforcing the back plate, the outer casing, and the door.

Figure 13:
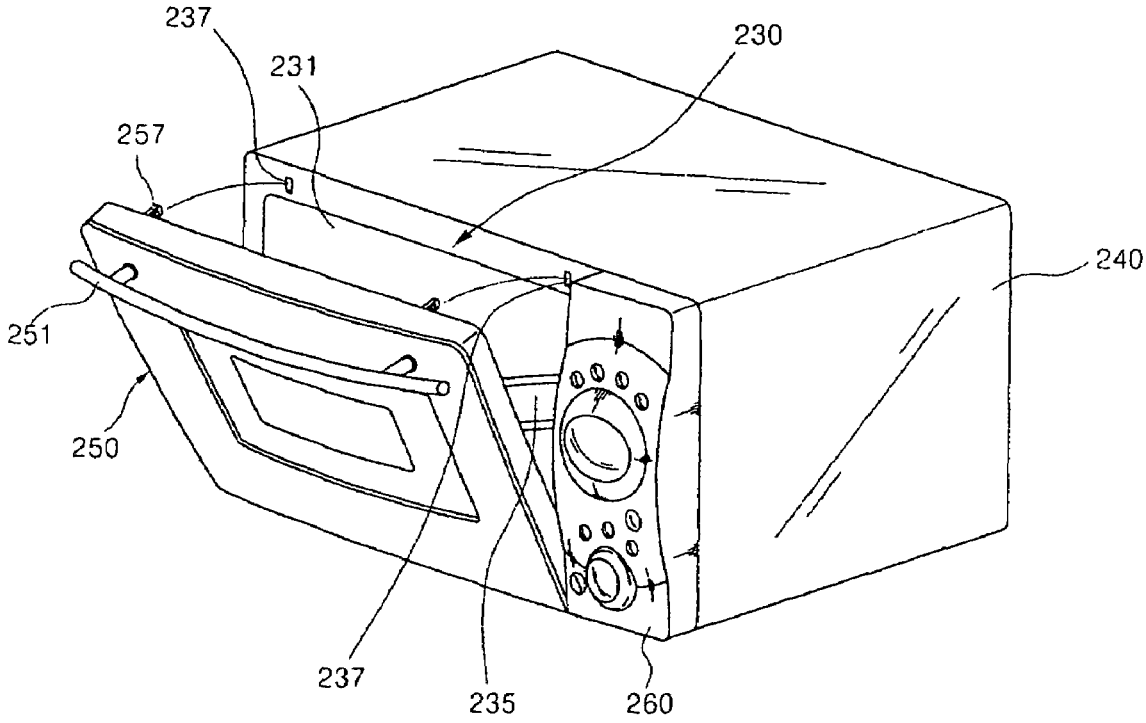
FIG. 13 is a perspective view showing a configuration of a microwave oven according to a further preferred embodiment of the present invention.

In addition, structural features for reinforcement of the outer casing or back plate may be simultaneously or selectively employed in the microwave oven shown in FIG. 13.

According to the present invention described above, the following advantages can be obtained.

That is, the outer casing, the back plate and the door for defining the external appearance of the microwave oven are strengthened, and the rigidity of the microwave oven is increased as a whole. Therefore, there is an advantage in that the deformation due to an impact or repeated use can be minimized.

Further, since the convexo-concave reinforcements are formed on the back plate through the press working, resistance of the back plate against the external force is increased. Thus, there is another advantage in that the back plate cannot be easily deformed, even though the external force is exerted on the back plate.

Furthermore, the present invention is configured in such a manner that the convexo-concave reinforcements and the chamfers are formed on the surface and the corners of the outer casing. Thus, there is a further advantage in that the outer casing cannot be easily deformed even though the external force or impact is exerted on the outer casing.

In addition, the present invention is configured in such a manner that the reinforcing plate is installed in the door at a side opposite to which the door is hingedly connected to the cavity assembly of the microwave oven to serve as a pivot center. Thus, even though the user applies the force to the door in order to open and close the door, the deformation in the door is relatively reduced. Therefore, there is a still further advantage in that any gap is not produced between the door and the front surface of the cavity assembly in spite of the long-term use. Accordingly, a risk of the leakage of microwaves can be reduced and cooking performance is maintained in accordance with a design specification.

The scope of the invention is not limited to the aforementioned embodiments of the present invention but should be defined by the appended claims. It is apparent that those skilled in the art can make various changes or modifications thereto without departing from the spirit and scope of the invention.

What is claimed is:

1. A microwave oven, comprising:

a cavity assembly which defines a cooking chamber therein and functions as a framework of the microwave oven;

an outer casing which defines an external appearance of the microwave oven by enclosing the cavity assembly and interior parts and includes chamfers formed at corners thereof; and a door of which one side is connected to the cavity assembly to be a pivot center and which causes selectively the cooking chamber to be open and closed, wherein an angle between a line L extending along an external edge of the outer casing and a border line of the chamfer is within a range of 30 to 60 degrees.

2. The microwave oven as claimed in claim 1, wherein the chamfers are formed only at rear corners of the outer casing.

3. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein the door frame has a portion protruding away from the cooking chamber and a portion recessed inward toward the cooking chamber formed in parallel along edges of the door frame, and a choke structure for preventing microwaves from leaking out is provided along edges of a rear surface of the door frame.

4. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein the door frame has a portion protruding away from the cooking chamber and a portion recessed inward toward the cooking chamber formed in parallel along edges of the door frame, and a choke structure for preventing microwaves from leaking out is provided along edges of a rear surface of the door frame, and wherein the reinforcing member is bent several times perpendicularly to a longitudinal direction thereof so that it can be simultaneously mounted on the protruding and recessed portions.

5. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein a protruding portion and a recessed portion are formed in parallel along edges of the door frame, and a choke structure for preventing microwaves from leaking out is provided along edges of a rear surface of the door frame, and wherein the reinforcing member is bent once perpendicularly to a longitudinal direction thereof so that it can be mounted on a surface of the protruding portion and a connecting surface between the protruding and recessed portions.

6. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein a protruding portion and a recessed portion are formed in parallel along edges of the door frame, and a choke structure for preventing microwaves from leaking out is provided along edges of a rear surface of the door frame, and wherein the reinforcing member is formed of an elongated plate with a predetermined width corresponding to that of the protruding portion so that it can be mounted on the protruding portion.

7. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein a protruding portion and a recessed portion are formed in parallel along edges of the door frame, and a choke structure for preventing microwaves from leaking out is provided along edges of a rear surface of the door frame, and wherein the reinforcing member is mounted to a rear surface of the door panel for connection with the handle and includes mounting portions fastened to the handle at both ends thereof and a linking portion with a predetermined length for linking the mounting portions.

8. The microwave oven as claimed in claim 7, wherein a cross-sectional length of the linking portion of the reinforcing member is formed to be smaller than those of the mounting portions.

9. A microwave oven, comprising:

a cavity assembly which defines a cooking chamber therein and functions as a framework of the microwave oven;

an outer casing which defines an external appearance of the microwave oven by enclosing the cavity assembly and interior parts; and a door of which one side is connected to the cavity assembly to be a pivot center and which causes selectively the cooking chamber to be open and close, wherein the door includes:

a door frame which defines a framework of the door;

a door panel installed at a front surface of the door frame for defining an external appearance of the door;

a handle which is installed on the door panel and on which an operating force for opening and closing the door is exerted; and a reinforcing member mounted on a side, opposite to the pivot center, where the handle is provided, wherein the door frame has an outer peripheral portion having a cross-sectional shape in the form of a reversed "S".

* * * * *